United States Patent [19]

Nelson

[11] 4,041,817

[45] Aug. 16, 1977

[54] PUNCH HOLDER AND STRIPPER COMBINATION

[75] Inventor: Paul Chris Nelson, Lake City, Minn.

[73] Assignee: Houdaille Industries, Inc., Buffalo, N.Y.

[21] Appl. No.: 730,089

[22] Filed: Oct. 6, 1976

[51] Int. Cl.[2] ..... B26F 1/14

[52] U.S. Cl. ..... 83/139; 83/552

[58] Field of Search ..... 83/139, 138, 552

[56] References Cited

U.S. PATENT DOCUMENTS 3,485,122 12/1969 Achler et al. ..... 83/139

*Primary Examiner*—J. M. Meister

*Attorney, Agent, or Firm*—Hill, Gross, Simpson, Van Santen, Steadman, Chiara & Simpson

[57] ABSTRACT

A punch holder and stripper assembly is shown in which a punch holding body is provided with a reduced outer diameter boss section projecting therefrom terminating in an end face which has a bore opening thereinto which receives the punch, the punch projecting from the reduced diameter section of the holder and terminating in a punching face. An elastomeric stripper, preferably of a type of urethane rubber, is attached to and carried by the punch holder. The stripper has an inner diameter received around the reduced diameter portion of the holder and extending beyond the holder in radially spaced relationship with the projecting portion of the punch. The stripper either terminates adjacent the punching face or is equipped with an end cap terminating adjacent the punching face.

5 Claims, 2 Drawing Figures

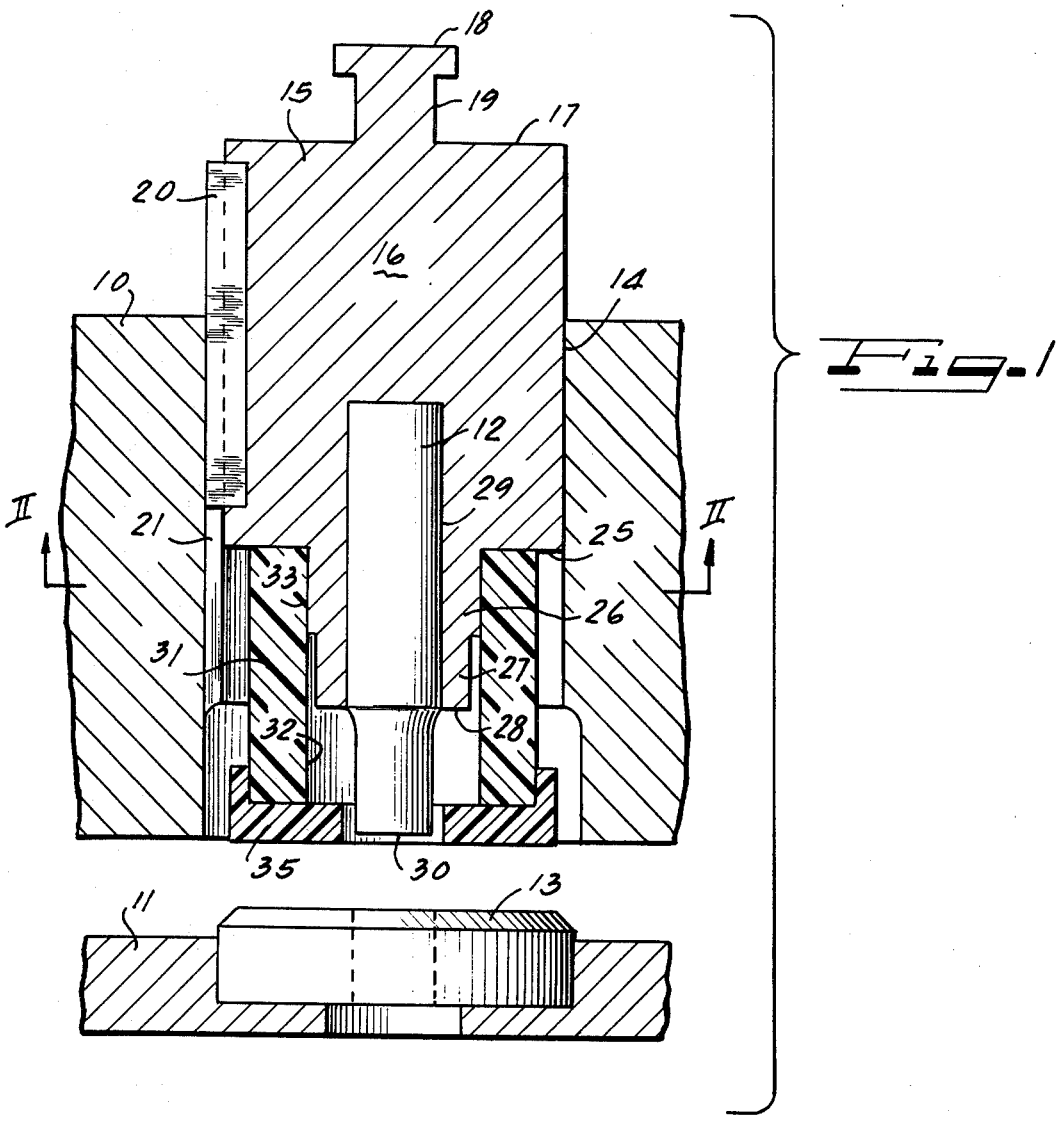
Fig. 1
Fig. 2
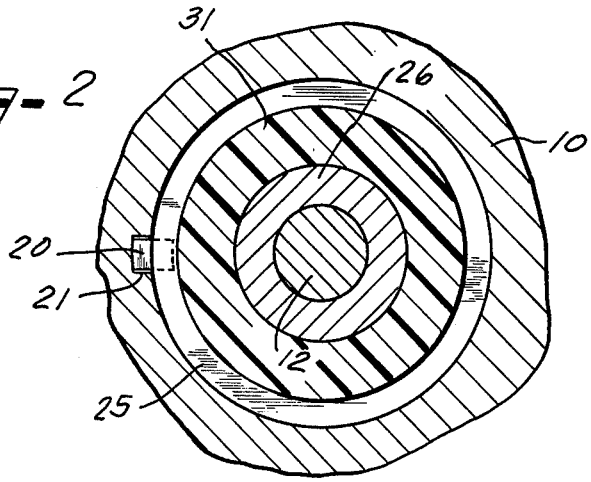

PUNCH HOLDER AND STRIPPER COMBINATION

BACKGROUND OF THE INVENTION

1. Field of the Invention

This invention relates to punch holders and more particularly to a punch holder-stripper assembly.

2. Prior Art

Metal punching devices, particularly sheet metal punching machines utilize a punch which is carried in a punch holder. The punch holder is larger than the punch and has an end face from which the punch projects. Although the specific shape of the punch holder differs from application to application, and may for example, differ for hard punch and die setups to be used in bed presses, punch-die units used in such presses or brake presses and drop-in holders used in single station and turret punch presses, a common feature is the fact that the holder has a larger dimension than the punch and has a bore into which the punch is received or through which the punch extends, the punch projecting beyond the punch holder and terminating in a punching end or tip.

Heretofore, it has been known to use stripping devices in association with punches to insure that the punched material is stripped from the punch tip. Such stripping devices have either been separate from the punch-punch holder unit or have been attached to the punch. A presently popular stripper construction consists of a polyurethane tube which is slipped over the projecting portion of the punch and grips the outer surface of the punch in a press fit or a stress fit relation.

In order to increase the ability of such strippers to be used with a wide variety of punches, it is common to form most punches with a cylindrical body section which thereafter tapers down to the tip, the tip being formed in whatever cross-section shape is desired.

Modifications of the elastomeric strippers heretofore used include simple tubes having a length sufficient to terminate a tube end adjacent the punch tip, closed end cup shaped units such as shown in the Archbold et al U.S. Pat. No. 3,234,835 and capped tube strippers such as shown in the Achler et al U.S. Pat. No. 3,485,122.

Although such prior art elastomeric strippers have represented a substantial advance in the art from prior used coil spring strippers, their method of attachment to the punch has numerous disadvantages. First, the inner diameter of the tube must be matched to the outer diameter of the punch body. Thus since a very wide range of punch body sizes exist, it has been necessary to stock a very large range of stripper sizes. Secondarily, numerous punches do not have a projecting portion which is cylindrical. Thus, the inside dimension and shape of the stripper had to be formed to accommodate the noncylindrical punch. This again required stocking of an additionally large number of stripper configurations and sizes. Thirdly, different punches for different applications project by differing amounts from the punch holder. In those instances where the amount of projection was relatively small, only very short stripper sections could be used. This can adversely effect the stripping force that can be generated, particularly when very small diameter axially short strippers were utilized. Fourthly, particularly where drop-in punch holders were utilized, such as in turret punch machines, the stripper always had to have a reduced outer diameter in order to allow clearance when inserted. Since many standard prior punch holders had relatively a small outer diameter dimension beyond the dimension of the punch, considerably less room was available for the stripper. Finally, since the strippers were received around the punch body and snugly engaged the punch body during compression of the stripper by movement of the punch through the workpiece, two undesirable problems occurred. First the stripper was compressed into tighter engagement with the punch body. Since there had to be relative movement between the punch body and the stripper, this compression created a friction which had to be overcome. Secondarily, a great deal of wear occurred on the inner dimension faces of the stripper.

It would therefore be an advance in the art to provide a stripper-punch holder combination which avoided a number of the above described deficiencies.

SUMMARY OF THE INVENTION

My invention provides a punch holder-stripper-punch assembly wherein a relatively large outer diameter punch holder is utilized. The punch holder has a boss of reduced diameter projecting from one end thereof and terminating in an end wall through which the holder carried punch projects, the holder carried punch having a maximum diameter less than the diameter of the reduced diameter punch. The stripper, preferably a urethane tube, is attached to the punch holder rather than to the punch. For this purpose, the reduced diameter boss of the punch holder has a cylindrical outer surface having a sufficient axial length to provide an adequate interference stress or press fit seating with an axial end section of the stripper.

Since the stripper is attached to the punch holder, to the extent that it projects beyond the end of the punch holder, it will encircle the punch in radial spaced relationship therewith thereby eliminating the punch body-stripper contact above described.

Secondarily, since the number of punch holder outer dimension sizes is considerably less than the number of punch outer dimension sizes, stocking requirements of stripping sizes are greatly reduced. For example, in most turret punches, only three or four different sized punch holder receiving openings are provided. However a wide variety of punch holders for each turret opening size are provided. These punch holders will then carry punches of different sizes so that a wide number of punch sizes will be carried by a class of punch holders having a common outer dimension. Since the stripper of my invention is carried by the punch holder, irrespective of the punch size carried by the various punch holders of any given holder outer dimension group, only one stripper diameter size is required.

Further, because the stripper is carried by the punch holder, the length of the reduced diameter boss of the punch holder can be chosen so as to provide an optimum stripper length irrespective of the extent of projection, both maximum and minimum, of the punch.

The strippers of my invention can be used with or without a cap, or may be formed as end walled cup shaped strippers if desired.

It is therefore an object of this invention to provide an improved punch-stripper assembly.

It is another more important object of this invention to provide a combined punch holder-stripper assembly.

It is another and more particular object of this invention to provide a punch holder having a reduced diameter boss adjacent the punch carrying end which receives an elastomeric stripper in press fit relationship therewith, the stripper projecting beyond the end of the punch holder in radially spaced relationship to a punch carried by the holder.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 1 is a fragmentary cross-sectional view of the turrets of a turret punch showing the upper turret equipped with a punch holder-stripper assembly according to this invention.

FIG. 2 is a fragmentary cross-sectional view of the punch holder-stripper assembly of FIG. 1 taken along the lines II—II of FIG. 1.

DESCRIPTION OF THE PREFERRED EMBODIMENTS

FIG. 1 illustrates, in cross section, a punch and die assembly as utilized in a turret punch machine. The machine includes upper 10 and lower 11 rotatable turrets with the upper turret 10 carrying punches 12 and lower turret carrying dies 13. The configuration and mounting of the die 13 in the lower turret forms no part of this invention and will not be described in greater detail.

As is common in the industry, the upper turret 10 has a plurality of circumferentially spaced openings 14 therethrough which are dimensioned to receive punch holders. The punches 12 are carried in punch holders 15 which consist of a main body 16 which may be equipped at one end thereof 17 with a T head cross section projection 18 which is adapted to be received in a T slot in the ram of the machine tool to reciprocate the punch holder under the influence of the ram. The groove 19 formed by the T shaped cross section head when not gripped by the ram, may be used to axially position the punch holder in the turret by engagement with a machine tool carried projection.

As is known in the art, the punch holder may be equipped with one or more axially extending radially projecting key members 20 which index with key slots 21 formed in the opening 14.

Consistent with my invention, the punch holder and the respective opening 14 are of larger diameter than heretofore and the punch holder has a ledged face 25 opposite the face 17 from which a centrally located circular boss 26 projects. The boss may extend at a constant diameter or may be ledged to provide a reduced diameter terminal end portion 27 terminating in an end face 28. A punch receiving opening 29 extends into the punch holder body from the face 28 and is preferably coaxial with the punch holder. The punch 12 is received in the opening 29 and projects beyond the face 28 terminating in a punching face 30 which may have any desired cross-sectional shape.

Heretofore, the punch holders normally had constant outer diameters or were tapered at the bottom edge. Tho portion of the punch projecting from the holder generally included a cylindrical body portion around which was received a stripper such as shown in the Achler et al U.S. Pat. No. 3,485,122, the teachings of which are herein incorporated by reference.

In my invention, the stripper 31, which is preferably of an elastomeric material, and most preferably of a polyurethane, consists of a tubular body having an inner diameter 32 which corresponds to the outer diameter 33 of the boss 26. The stripper is fitted on the boss either in a press fit or a stress or interference fit relationship and is bottomed on the face ledge 25. Because the stripper is carried by the boss 26, the projecting portion of the stripper extending beyond the face 28 is in radially spaced relation to the punch 12. Further because the amount of projection of the punch beyond the face 28 is relatively small in comparison to the length available between the face 25 and the punching face 30, the stripper 31 of this invention can be considerably longer than the prior art strippers.

Additionally because the diameter of the punch body is preferably increased from that used in the prior art, and particularly the punch holders used in prior art turret punching machines, even though the thickness of the boss 26 must be accommodated between the outer diameter of the punch and the inner diameter of the stripper, the wall thickness of the stripper can be maintained the same, or even increased.

The stripper 31 can be cut from a length of tube and may be equipped with a stripper cap 35 if desired.

Since the dimensions of the punch holder, and particularly the outer diameter 33 of the boss 26, can be maintained the same for a large variety of punch diameter sizes, it only being necessary to vary the diameter of cross section size of the bore 29, a single stripper diameter can be used in association with a large variety of punches.

Thus, this invention eliminates the prior need for special designed strippers and for stocking of a large variety of inner dimensioned strippers. Additionally, because of the ability to use a relatively long stripper, as well as the ability to use larger wall thickness strippers, both increased life and greater stripping force can be obtained.

Although the invention has herein been described in connection with a punch holder of the type used in a turret machine, it is clear that the invention is equally usable in connection with fixed plate punching assemblies of the type shown in FIG. 1 of the aforementioned Achler et al patent wherein the punch holder would be provided with a projecting punch encircling boss for attachment of the stripper.

Although the teachings of my invention have herein been discussed with reference to specific theories and embodiments, it is to be understood that these are by way of illustration only and that others may wish to utilize my invention in different designs or applications.

I claim as my invention:

1. A punch holding device for use in punching comprising: a punch holder having a first body section with an outer diameter dimensioned to be received in a punch holder opening in a punching machine in a relatively close fit relationship, a second body section having a reduced outer diameter smaller than the outer diameter of the first body section and coaxial therewith projecting from the first body section and terminating in an end face, a punch receiving bore in said punch holder open to the end face having a diameter less than the outer diameter of the second body section, an elastomeric stripper having an outer diameter less than the outer diameter of the first body section and an inner diameter substantially equal to the outer diameter of the second body section received on the second body section and projecting therefrom beyond the end face.

2. A punch holding device for use in punching comprising: a punch holder member having a first body portion with an end face, a second body portion projecting from the end face terminating in a second end face remote from the end face, the second body portion having a bore extending thereinto from the second end face with a punch received therein projecting beyond the second end face, the punch having an outer diameter less than the second section, an elastomeric stripper having an inner diameter substantially equal to the diameter of the second body section, the stripper press fit on the second body section projecting beyond the second end face in circumferentially spaced relationship to the punch.

3. The device of claim 2 wherein the first body section has a dimension at the end face greater than the outer diameter of the second body section and the stripper has an axial end face abutting the end face of the first body section.

4. In a punch holder having a body with a punch receiving bore therein with a punch in said opening projecting from an end face of the body and a stripper encircling the projecting portion of the punch, the improvement of the body having a reduced dimension projecting boss coaxial with the bore, the boss having an outer diameter greater than the diameter of the punch receiving bore, the boss terminating in an end face from which the punch projects, the stripper having an axial end portion received around the boss and held thereon, the stripper having an inner diameter greater than the outer diameter of the punch and substantially equal to the outer diameter of the boss, the stripper projecting beyond the boss in radially spaced relation to the punch.

5. The device of claim 4 wherein the stripper has an axial end face abutting a ledge wall of the punch holder from which the boss projects.

* * * * *